US011137699B1

(12) United States Patent
Williamson

(10) Patent No.: US 11,137,699 B1
(45) Date of Patent: Oct. 5, 2021

(54) TONER CONTAINER HAVING A REDUCED AUGER FLIGHT TO ACCOMMODATE BI-DIRECTIONAL ROTATION OF THE AUGER

(71) Applicant: LEXMARK INTERNATIONAL, INC., Lexington, KY (US)

(72) Inventor: Randal Scott Williamson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 17/151,866

(22) Filed: Jan. 19, 2021

Related U.S. Application Data

(60) Provisional application No. 63/032,837, filed on Jun. 1, 2020.

(51) Int. Cl.
*G03G 15/08* (2006.01)
*G03G 21/10* (2006.01)
*G03G 21/18* (2006.01)

(52) U.S. Cl.
CPC ..... *G03G 15/0867* (2013.01); *G03G 15/0848* (2013.01); *G03G 15/0891* (2013.01); *G03G 21/105* (2013.01); *G03G 21/1896* (2013.01); *G03G 2215/0675* (2013.01); *G03G 2215/085* (2013.01); *G03G 2215/0827* (2013.01)

(58) Field of Classification Search
CPC ..... G03G 15/0867; G03G 21/105; G03G 15/0891; G03G 15/0848; G03G 2215/0827; G03G 2215/0675; G03G 15/0875; G03G 15/0879; G03G 2215/068; G03G 2215/0695; G03G 2215/085; G03G 2215/0852; G03G 15/0863; G03G 21/1857; G03G 21/1896
See application file for complete search history.

(56) References Cited

U.S. PATENT DOCUMENTS 5,634,169 A * 5/1997 Barry ..... G03G 15/0822 399/12
5,995,772 A * 11/1999 Barry ..... G03G 15/0822 399/12
6,466,763 B1 10/2002 Campbell et al.
6,546,225 B2 4/2003 Wang
7,257,363 B2 8/2007 Baker et al.
7,263,325 B2 8/2007 Marin et al.
7,383,014 B2 6/2008 Baker et al.
(Continued)

*Primary Examiner* — Walter L Lindsay, Jr.
*Assistant Examiner* — Laura Roth
(74) *Attorney, Agent, or Firm* — Justin M. Tromp

(57) ABSTRACT

A toner container according to one example embodiment includes a housing having a reservoir for holding toner and a rotatable auger in the reservoir. A screw flight of the auger is configured to move toner away from a first end of the auger and toward a second end of the auger when the auger rotates in an operative rotational direction. A segment of the screw flight at a first end of the screw flight has an outer diameter that is reduced in comparison with an outer diameter of the screw flight outside the segment of the screw flight to reduce an efficiency of the auger at the first end of the screw flight for reducing toner packing against an interior wall of the housing when the auger rotates in a direction counter to the operative rotational direction.

10 Claims, 9 Drawing Sheets

(56) References Cited

U.S. PATENT DOCUMENTS

| | | | | |
|---|---|---|---|---|
| 7,561,833 | B2 * | 7/2009 | Stelter | G03G 15/0891 399/258 |
| 8,064,815 | B2 | 11/2011 | Gibson et al. | |
| 8,315,548 | B2 | 11/2012 | Gayne et al. | |
| 8,660,469 | B2 | 2/2014 | Carter, II et al. | |
| 8,867,966 | B2 | 10/2014 | Acosta et al. | |
| 9,488,955 | B2 | 11/2016 | Reidhaar | |
| 9,929,864 | B2 | 3/2018 | Booth et al. | |
| 10,527,967 | B1 | 1/2020 | Williamson et al. | |
| 10,527,969 | B1 * | 1/2020 | Williamson | G03G 15/0867 |
| 2007/0092301 | A1 * | 4/2007 | Bessette | G03G 15/0856 399/254 |
| 2009/0136259 | A1 * | 5/2009 | Ito | G03G 21/105 399/120 |
| 2010/0080600 | A1 * | 4/2010 | Okamoto | G03G 21/12 399/71 |

* cited by examiner

TONER CONTAINER HAVING A REDUCED AUGER FLIGHT TO ACCOMMODATE BI-DIRECTIONAL ROTATION OF THE AUGER

CROSS REFERENCES TO RELATED APPLICATIONS

This application claims priority to U.S. Provisional Patent Application Ser. No. 63/032,837, filed Jun. 1, 2020, entitled "Toner Container Having a Reduced Auger Flight to Accommodate Bi-Directional Rotation of the Auger," the content of which is hereby incorporated by reference in its entirety.

BACKGROUND

1. Field of the Disclosure

The present disclosure relates generally to image forming devices and more particularly to a toner container having a reduced auger flight to accommodate bi-directional rotation of the auger.

2. Description of the Related Art

In electrophotographic image forming devices, one or more replaceable toner containers may be used to supply toner for printing onto sheets of media. Each toner container often includes a toner agitator assembly that agitates and mixes toner stored in a toner reservoir to prevent the toner from clumping and that moves the toner to an outlet of the toner container. It is often desired for each toner container to communicate characteristics of the toner container to the image forming device for proper operation. For example, it may be desired to communicate such information as authentication or validation information, toner fill amount, toner color, toner type, etc.

SUMMARY

A toner container for use in an electrophotographic image forming device according to one example embodiment includes a housing having a reservoir for holding toner and an auger in the reservoir having a screw flight. The auger has a first end and a second end. The auger is rotatable about a rotational axis in an operative rotational direction for moving toner within the reservoir and in a direction counter to the operative rotational direction. The screw flight of the auger is configured to move toner away from the first end of the auger and toward the second end of the auger when the auger rotates in the operative rotational direction. A first end of the screw flight that is proximate to the first end of the auger is positioned adjacent to an interior wall of the housing that is transverse to the rotational axis of the auger. A segment of the screw flight at the first end of the screw flight has an outer diameter that is reduced in comparison with an outer diameter of the screw flight outside the segment of the screw flight to reduce an efficiency of the auger at the first end of the screw flight for reducing toner packing against the interior wall of the housing when the auger rotates in the direction counter to the operative rotational direction.

A toner container for use in an electrophotographic image forming device according to another example embodiment includes a housing having a reservoir for holding toner and an outlet port on the housing in fluid communication with the reservoir for exiting toner from the toner container. An input gear is positioned on the housing for mating with a corresponding output gear in the image forming device when the toner container is installed in the image forming device. An encoded member is encoded with identifying information of the toner container and is operatively connected to the input gear such that rotation of the input gear in a first rotational direction causes movement of the encoded member for communicating the identifying information of the toner container to a sensor of the image forming device when the toner container is installed in the image forming device. An auger is rotatably positioned in the reservoir and has a screw flight. The auger has a first end and a second end. The auger is operatively connected to the input gear such that rotation of the input gear in a second rotational direction opposite the first rotational direction causes the auger to rotate in an operative rotational direction and rotation of the input gear in the first rotational direction causes the auger to rotate counter to the operative rotational direction. The screw flight of the auger is configured to move toner away from the first end of the auger and toward the second end of the auger to the outlet port when the auger rotates in the operative rotational direction for exiting toner from the toner container. An end segment of the screw flight at a first end of the screw flight that is proximate to the first end of the auger has an outer diameter that is less than an outer diameter of the screw flight outside the end segment of the screw flight.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
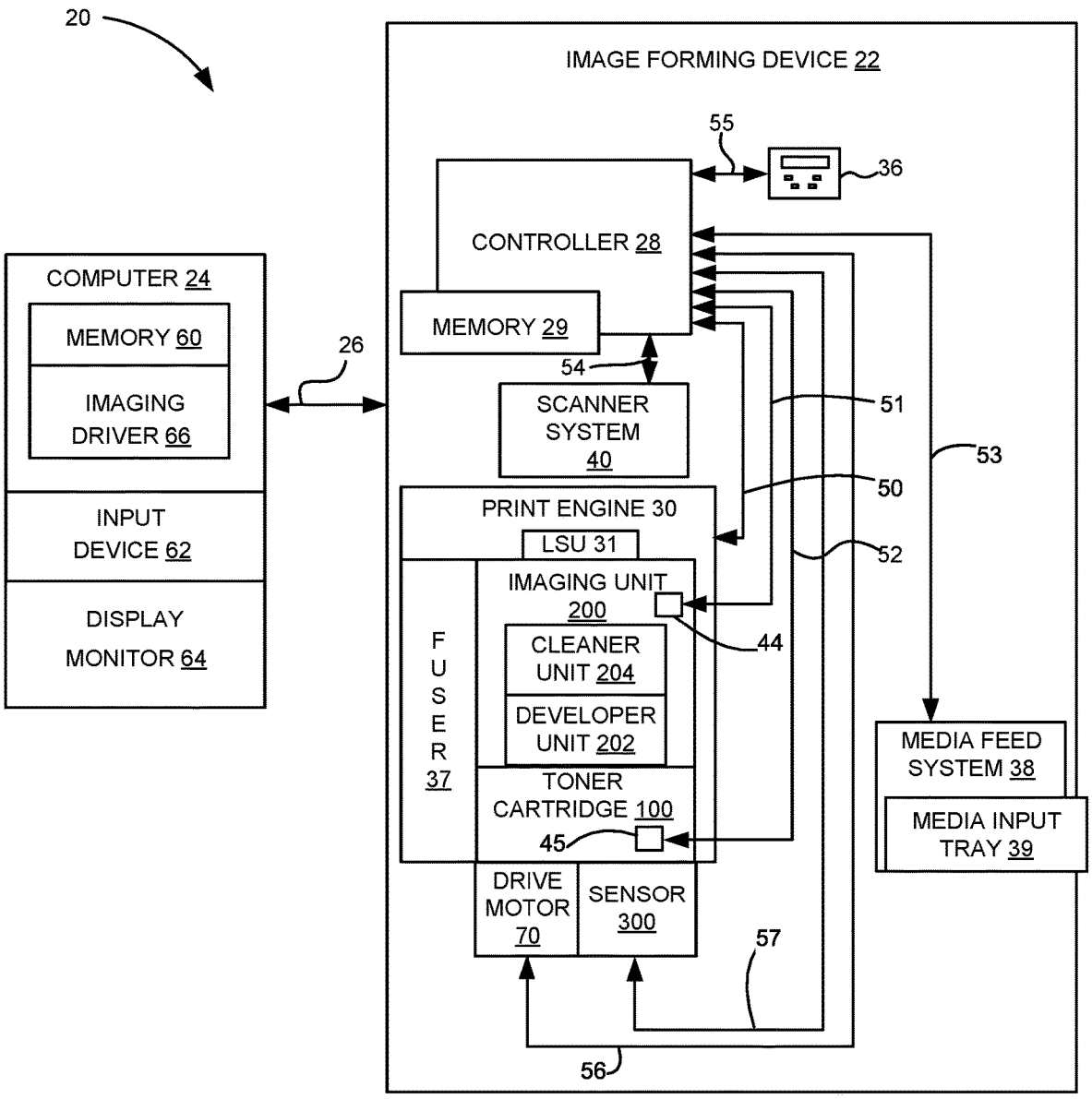
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39, a scanner system 40, a drive motor 70 and a sensor 300. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more application-specific integrated circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Controller 28 communicates with drive motor 70 via a communications link 56. Controller 28 communicates with sensor 300 via a communications link 57. Controller 28 processes print and scan data and operates print engine 30 during printing and scanner system 40 during scanning. Processing circuitry 44, 45 may provide authentication functions, safety and operational interlocks, operating parameters and usage information related to imaging unit 200 and toner cartridge 100, respectively. Each of processing circuitry 44, 45 includes a processor unit and associated electronic memory. As discussed above, the processor may include one or more integrated circuits in the form of a microprocessor or central processing unit and may include one or more application-specific integrated circuits (ASICs). The memory may be any volatile or non-volatile memory or combination thereof or any memory device convenient for use with processing circuitry 44, 45.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and a fuser 37, all mounted within image forming device 22. Imaging unit 200 is removably mounted in image forming device 22 and includes a developer unit 202 that houses a toner reservoir and a toner development system. In one embodiment, the toner development system utilizes what is commonly referred to as a single component development system. In this embodiment, the toner development system includes a toner adder roll that provides toner from the toner reservoir of developer unit 202 to a developer roll. A doctor blade provides a metered uniform layer of toner on the surface of the developer roll. In another embodiment, the toner development system utilizes what is commonly referred to as a dual component development system. In this embodiment, toner in the toner reservoir of developer unit 202 is mixed with magnetic carrier beads. The magnetic carrier beads may be coated with a polymeric film to provide triboelectric properties to attract toner to the carrier beads as the toner and the magnetic carrier beads are mixed in the toner reservoir of developer unit 202. In this embodiment, developer unit 202 includes a magnetic roll that attracts the magnetic carrier beads having toner thereon to the magnetic roll through the use of magnetic fields. Imaging unit 200 also includes a cleaner unit 204 that houses a photoconductive drum and a waste toner removal system.

In the embodiment illustrated, toner cartridge 100 is removably mounted in imaging forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner reservoir in developer unit 202.

The electrophotographic printing process is well known in the art and, therefore, is described briefly herein. During a printing operation, laser scan unit 31 creates a latent image on the photoconductive drum in cleaner unit 204. Toner is transferred from the toner reservoir in developer unit 202 to the latent image on the photoconductive drum by the developer roll (in the case of a single component development system) or by the magnetic roll (in the case of a dual component development system) to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
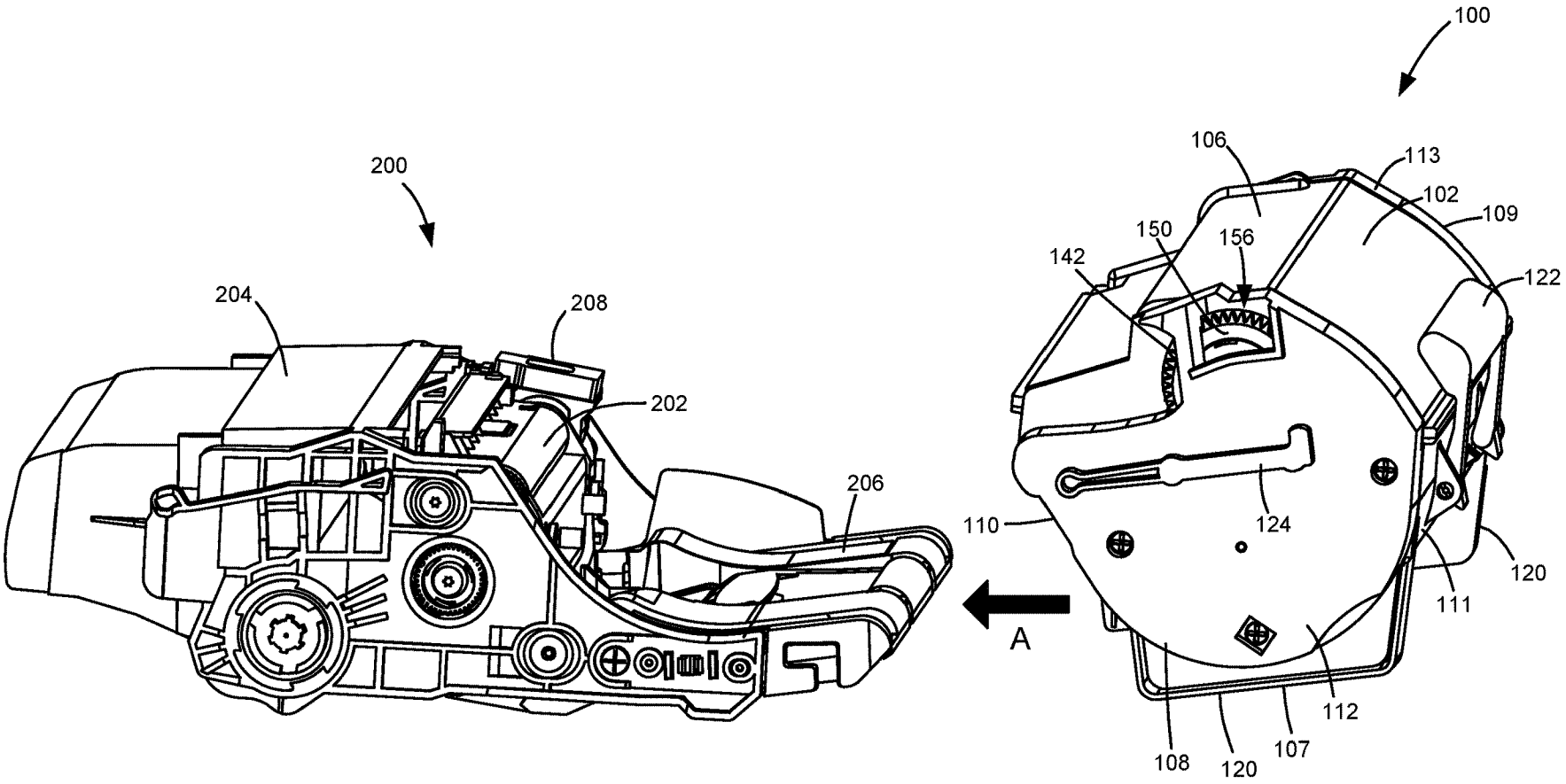
FIG. 2 is a perspective view of a toner cartridge and an imaging unit according to one example embodiment.

Referring now to FIG. 2, toner cartridge 100 and imaging unit 200 are shown according to one example embodiment. Imaging unit 200 includes a developer unit 202 and a cleaner unit 204 mounted on a common frame 206. Developer unit 202 includes a toner inlet port 208 positioned to receive toner from toner cartridge 100. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto frame 206 in a mating relationship with developer unit 202 of imaging unit 200 as indicated by the arrow A shown in FIG. 2, which also indicates the direction of insertion of imaging unit 200 and toner cartridge 100 into image forming device 22. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, cleaner unit 204 or frame 206 or to clear a media jam.

With reference to FIGS. 2-5, toner cartridge 100 includes a housing 102 having an enclosed reservoir 104 (FIG. 5) for storing toner. Housing 102 includes a top 106, a bottom 107, first and second sides 108, 109, a front 110 and a rear 111. Front 110 of housing 102 leads during insertion of toner cartridge 100 into image forming device 22 and rear 111 trails. In one embodiment, each side 108, 109 of housing 102 includes an end cap 112, 113 mounted, e.g., by fasteners or a snap-fit engagement, to side walls 114, 115 of a main body 116 of housing 102. In this embodiment, housing 102 includes main body 116 as well as various attachments (direct and indirect) thereto forming the overall body of toner cartridge 100 including, for example, end caps 112, 113. An outlet port 118 in fluid communication with reservoir 104 is positioned on front 110 of housing 102 near side 109 for exiting toner from toner cartridge 100. Toner cartridge 100 may include a shutter or cover that is movable between a closed position blocking outlet port 118 and an open position permitting toner to flow from outlet port 118 in order to prevent toner from escaping outlet port 118 when toner cartridge 100 is not installed in image forming device 22. Housing 102 may include legs 120 on bottom 107 to assist with the insertion of toner cartridge 100 into image forming device 22 and to support housing 102 when toner cartridge 100 is set on a flat surface. A handle 122 may be provided on top 106 and/or rear 111 of housing 102 to assist with insertion and removal of toner cartridge 100 into and out of image forming device 22.

Figure 3:
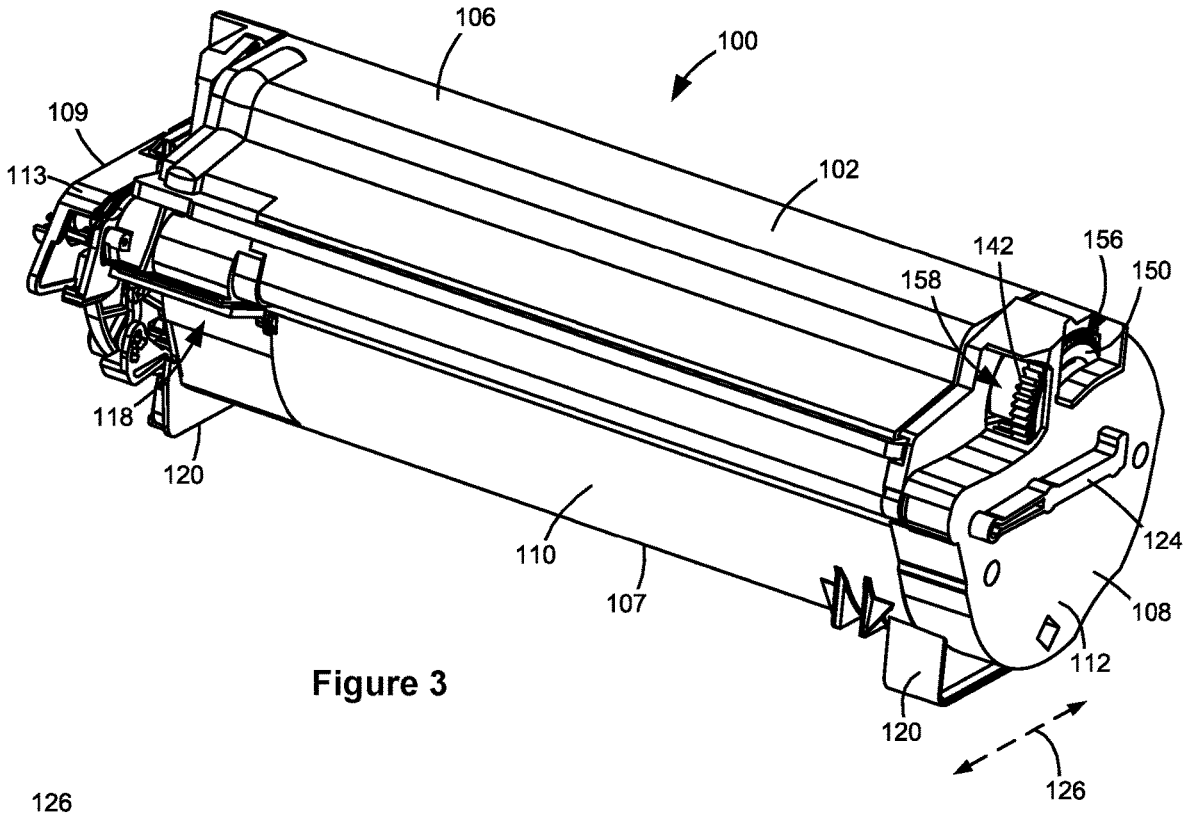
FIG. 3 is a front perspective view of the toner cartridge shown in FIG. 2.
Figure 4:
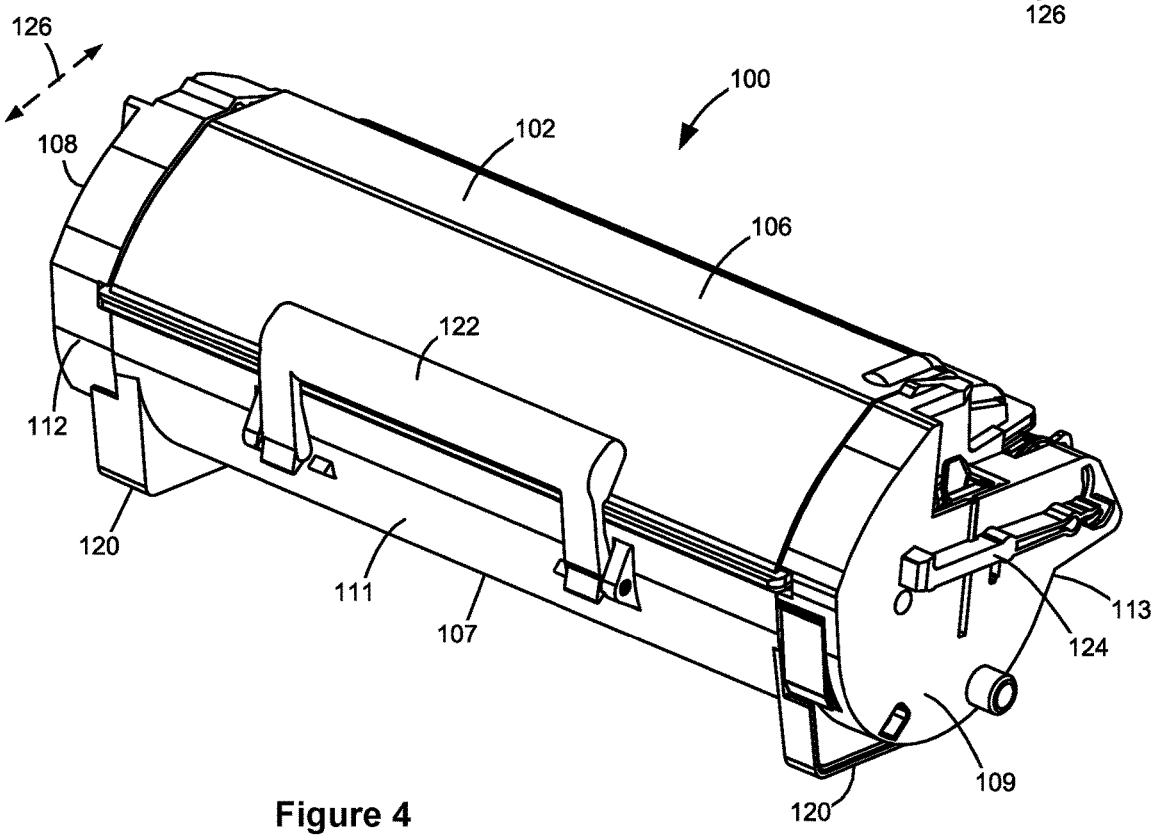
FIG. 4 is a rear perspective view of the toner cartridge shown in FIGS. 2 and 3.

Sides 108, 109 may each include a positioning guide 124 that extends outward from the respective side 108, 109 to assist, the insertion of toner cartridge 100 into image forming device 22. Positioning guides 124 travel in corresponding guide slots in image forming device 22 that guide the insertion of toner cartridge 100 into image forming device 22. In the example embodiment illustrated, a positioning guide 124 is positioned on the outer side of each end cap 112, 113. Positioning guides 124 may run along a front-to-rear dimension 126 of housing 102, which extends from front 110 to rear 111, as shown in FIGS. 3 and 4.

Figure 5:
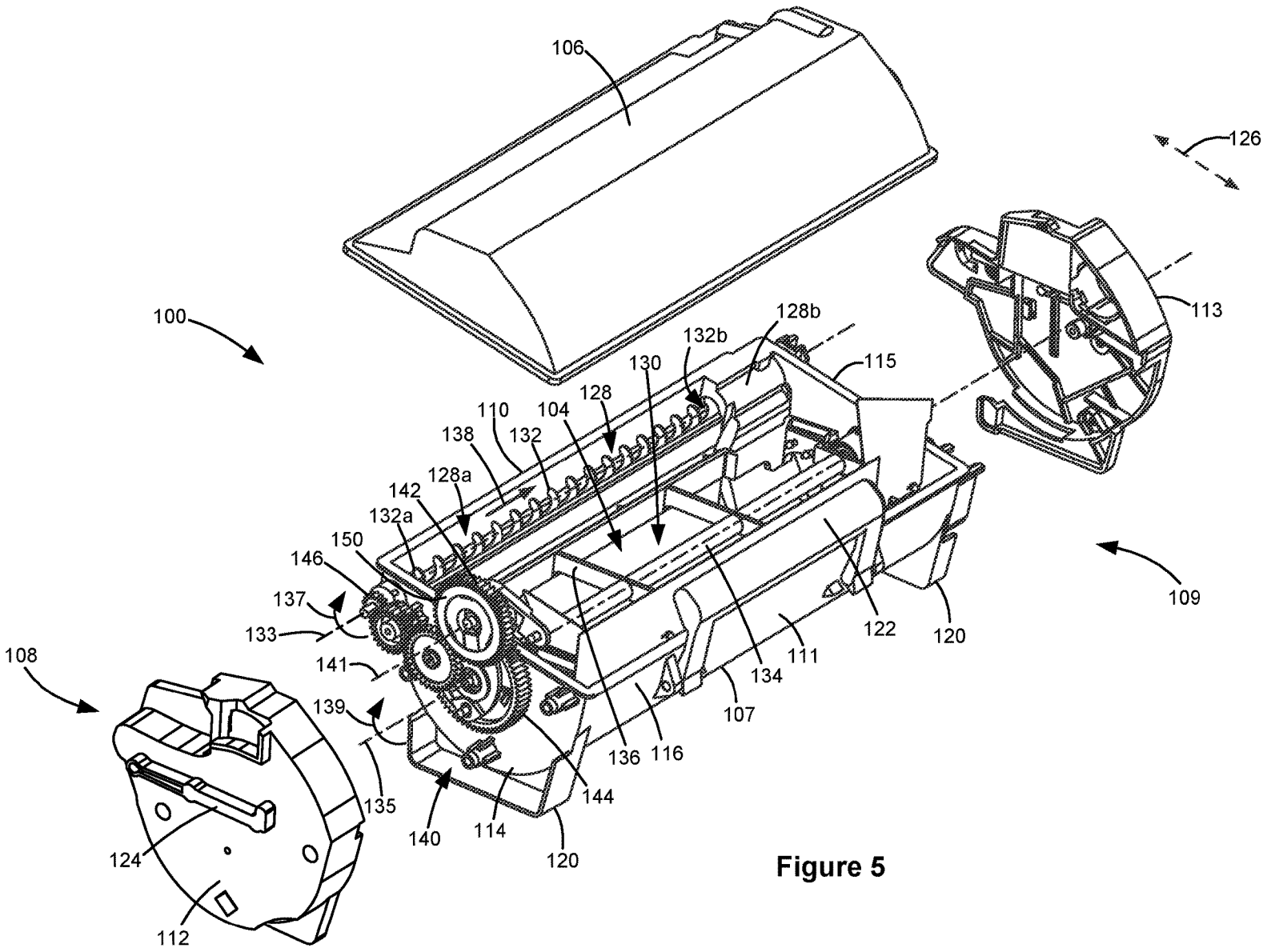
FIG. 5 is an exploded view of the toner cartridge shown in FIGS. 2-4 showing a toner agitator assembly of the toner cartridge according to one example embodiment.

With reference to FIG. 5, in the example embodiment illustrated, a toner agitator assembly 130 is rotatably positioned within toner reservoir 104. Toner agitator assembly 130 includes an auger 132 having first and second ends 132*a*, 132*b* and a spiral screw flight. Auger 132 is positioned in a channel 128 that runs along the front 110 of housing 102 from side wall 114 to side wall 115. Channel 128 is oriented generally horizontal when toner cartridge 100 is installed in image forming device 22. Auger 132 includes a rotational axis 133. In operation, auger 132 rotates in an operative rotational direction 137. Rotation of auger 132 in operative rotational direction 137 moves toner in channel 128 in a toner feed direction 138 away from first end 132*a* and toward second end 132*b* of auger 132 (away from side 108 and toward side 109) to deliver toner in channel 128 to outlet port 118, which is positioned at the bottom of channel 128 so that gravity assists in exiting toner through outlet port 118. Channel 128 includes an open portion 128*a* and may include an enclosed portion 128*b*. Open portion 128*a* is open to toner reservoir 104 and extends from side wall 114 toward second end 132*b* of auger 132. Enclosed portion 128*b* of channel 128 extends from side wall 115 and encloses second end 132*b* of auger 132. In this embodiment, outlet port 118 is positioned at the bottom of enclosed portion 128*b* of channel 128.

Toner agitator assembly 130 also includes a rotatable drive shaft 134 and one or more toner agitators 136 in the form of extensions outward from drive shaft 134. Drive shaft 134 includes a rotational axis 135. In the example embodiment illustrated, rotational axis 135 of drive shaft 134 is parallel to rotational axis 133 of auger 132. In operation, drive shaft 134 rotates in an operative rotational direction 139. Toner agitators 136 rotate with drive shaft 134 around rotational axis 135 when drive shaft 134 rotates in operative rotational direction 139. As drive shaft 134 rotates in operative rotational direction 139, toner agitators 136 agitate and mix the toner stored in toner reservoir 104 and, in the embodiment illustrated, move toner toward channel 128 where auger 132 moves the toner to outlet port 118. In the example embodiment illustrated, first and second ends of drive shaft 134 extend through aligned openings in side walls 114, 115, respectively. However, drive shaft 134 may take other positions and orientations as desired, Bushings may be provided on an inner side of each side wall 114, 115 where drive shaft 134 passes through side walls 114, 115.

A drive train 140 on housing 102 is operatively connected to auger 132 and drive shaft 134 and may be positioned within a space formed between end cap 112 and side wall 114, Drive train 140 includes an input gear 142 that engages with a corresponding output gear in image forming device 22 that provides rotational motion from drive motor 70 in image forming device 22 to input gear 142. Input gear 142 is rotatable about a rotational axis 141. In the embodiment illustrated, rotational axis 141 is orthogonal to front-to-rear dimension 126. As shown in FIG. 3, in one embodiment, a front portion of input gear 142 is exposed at the front 110 of housing 102 near the top 106 of housing 102 where input gear 142 engages the output gear in image forming device 22. In the embodiment illustrated, a front portion of input gear 142 is exposed in a cutout 158 formed in a front portion of end cap 112. With reference back to FIG. 5, in the embodiment illustrated, drive train 140 also includes a drive gear 144 on one end of drive shaft 134 that is connected to input gear 142 either directly or via one or more intermediate gears to rotate drive shaft 134. In the embodiment illustrated, drive train 140 also includes a drive gear 146 on first end 132*a* of auger 132 that is connected to input gear 142 either directly or via one or more intermediate gears to rotate auger 132.

Figure 6:
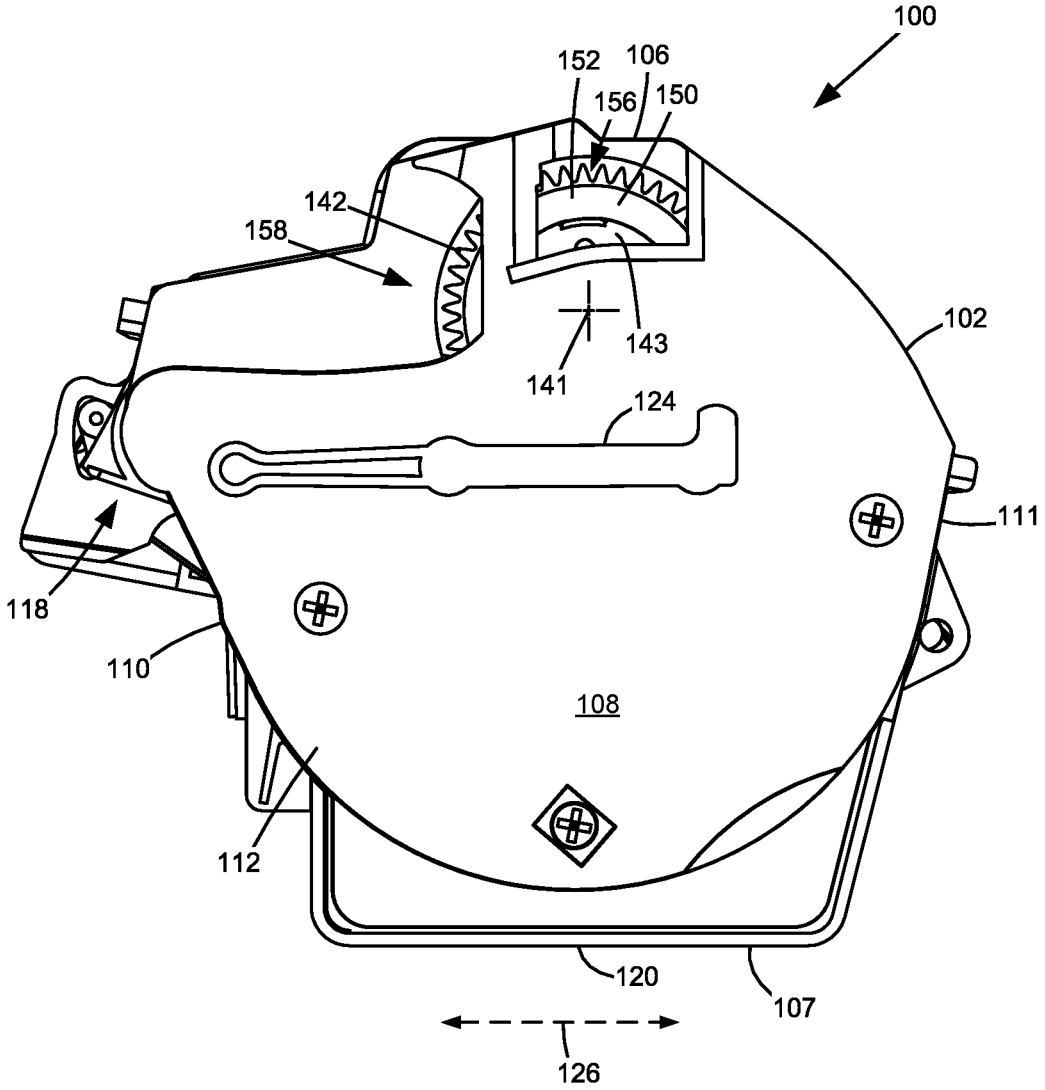
FIG. 6 is a side elevation view of the toner cartridge shown in FIGS. 2-5 showing an encoded member of the toner cartridge according to one example embodiment.
Figure 7:
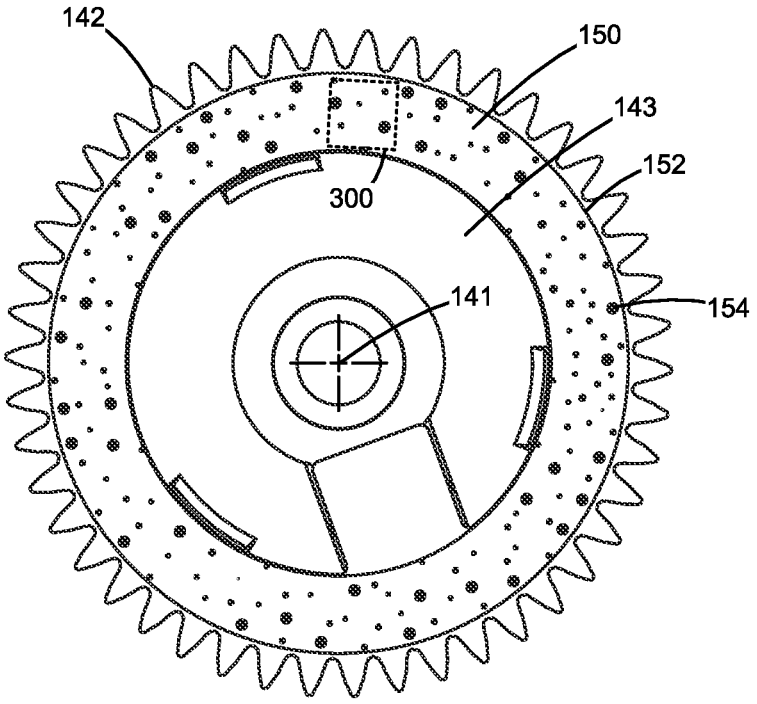
FIG. 7 is a side elevation view of the encoded member of the toner cartridge according to one example embodiment.

With reference to FIGS. 5-7, toner cartridge 100 includes an encoded member 150 that is movably connected to drive train 140, either directly or indirectly to input gear 142. In the example embodiment illustrated, encoded member 150 includes a rotatable disk 152 operatively connected to drive train 140, such as, for example, positioned on an outboard face 143 of input gear 142, coaxially with input gear 142 as illustrated. Disk 152 may be formed integrally with input gear 142 or separately attached to input gear 142. In other embodiments, encoded member 150 is, for example, translatable, such as by way of a rack and pinion arrangement or a cam and follower arrangement. Information pertaining to toner cartridge 100 is encoded on encoded member 150. Encoded member 150 is detectable by sensor 300 in image forming device 22 when toner cartridge 100 is installed in image forming device 22 permitting sensor 300 to communicate the encoded information of toner cartridge 100 to controller 28 of image forming device 22 via communications link 57. The encoded information may include, for example, authentication information such as a signature, serial number, or other identifier for authenticating or validating toner cartridge 100 upon installation of toner cartridge 100 in image forming device 22 or periodically during use of toner cartridge 100. The encoded information may include, for example, characteristics of toner cartridge 100 such as toner color, initial toner fill amount, toner type, geographic region, manufacture location, manufacture date, etc.

In the example embodiment illustrated, authentication information is encoded on encoded member 150 by randomly distributed magnetized particles 154 dispersed on disk 152, e.g., on the surface of disk 152 and/or within disk 152. Particles 154 are distributed randomly such that it is difficult to reproduce the exact distribution and alignment of particles 154 thereby making the distribution difficult to copy. In this embodiment, sensor 300 is positioned in close proximity to encoded member 150 when toner cartridge 100 is installed in image forming device 22, such as, adjacent to and facing the outboard side of disk 152 as schematically illustrated in FIG. 7. At predetermined times, such as upon the installation of a new toner cartridge in image forming device 22, sensor 300 measures the magnetic field of disk 152 in one, two or three orthogonal dimensions as disk 152 rotates due to rotation of input gear 142 by motor 70. The magnetic field values measured by sensor 300 are communicated to controller 28 via communications link 57. Controller 28 may then compare the magnetic field values received from sensor 300 to values stored during manufacture in non-volatile memory of processing circuitry 45 of toner cartridge 100. Controller 28 may confirm the authenticity of toner cartridge 100 to controller 28 if the magnetic field values received from sensor 300 match the values stored in non-volatile memory of processing circuitry 45.

While the example embodiment illustrated includes information encoded by a random distribution of magnetized particles and detection by measuring the magnetic field of the particles, it will be appreciated that information may be encoded by a random distribution of non-magnetized particles and detection may occur according to other means, such as, for example, by measuring an optical property of the particles. Further, in lieu of a random pattern, information may be encoded according to a predetermined pattern using any suitable indicia and detection method. However, as discussed above, it is preferred for authentication information to be encoded according to a random pattern so that encoded authentication information is more difficult for a counterfeiter to reproduce.

With reference to FIG. 6, in the example embodiment illustrated, at least a portion of encoded member 150 is exposed on the exterior of toner cartridge 100, e.g., above rotational axis 141 of input gear 142, for reading by sensor 300. For example, in the embodiment illustrated, encoded member 150 is exposed through a cutout 156 in end cap 112 that is positioned above rotational axis 141 of input gear 142. Although it is preferred for at least a portion of encoded member 150 to be exposed for reading by sensor 300 in order to ensure an accurate reading of encoded member 150, in other embodiments, encoded member 150 may be covered by a relatively thin material, e.g., in place of cutout 156, so long as sensor 300 is still able to accurately read encoded member 150 through the material.

Figure 8:
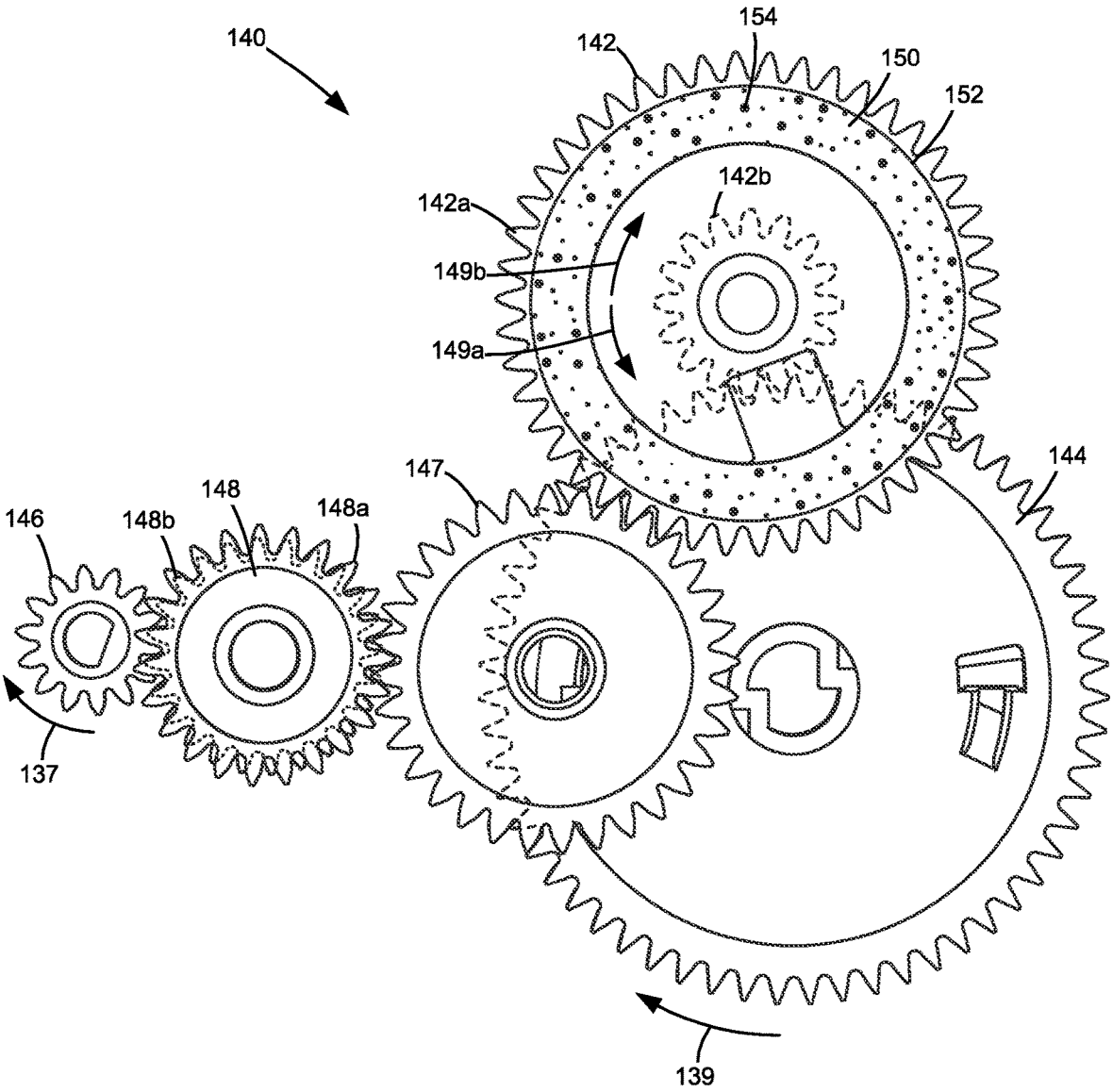
FIG. 8 is a side elevation view of a drive train of the toner cartridge according to one example embodiment.

FIG. 8 shows drive train 140 in greater detail according to one example embodiment. In the example embodiment illustrated, input gear 142 is a compound gear that includes a first portion 142*a* that mates with the corresponding output gear in image forming device 22 when toner cartridge 100 is installed in image forming device 22 and a second portion 142*b* that meshes with drive gear 144 in order to provide rotational motion to drive shaft 134. First portion 142*a* of input gear 142 also meshes with an idler gear 147 that, in turn, meshes with a compound idler gear 148. Compound idler gear 148 includes a first portion 148*a* that meshes with idler gear 147 and a second portion 148*b* that meshes with drive gear 146 in order to provide rotational motion to auger 132. It will be appreciated that the embodiment illustrated in FIG. 8 is merely an example and that drive train 140 may take many suitable configurations for transferring rotational motion from input gear 142 to toner agitator assembly 130 and to encoded member 150.

In some embodiments, in operation, controller 28 drives motor 70 in a first rotational direction to feed toner from toner cartridge 100 to developer unit 202 and in a second rotational direction to perform a reading of encoded member 150 by sensor 300. In particular, when controller 28 drives motor 70 in the first rotational direction, input gear 142 rotates in a first rotational direction 149*a* and, in turn, rotates auger 132 and drive shaft 134 in operative rotational directions 137, 139 to teed toner from outlet port 118 of toner cartridge 100 to inlet port 208 of developer unit 202. When controller 28 drives motor 70 in the second rotational direction, input gear 142 rotates in a second rotational direction 149*b*. Sensor 300 is configured to read encoded member 150 as input gear 142 rotates in rotational direction 149*b*. In this manner, sensor 300 is able to perform a reading of encoded member 150 separately from a toner feed operation so that the authenticity or validity of toner cartridge 100 may be checked prior to the first use of toner cartridge 100 or at other times when toner cartridge 100 is not in use.

In some embodiments, toner agitator assembly 130 includes a one-way clutch that limits the rotational motion of drive shaft 134 to operative rotational direction 139. For example, the one-way clutch may be operatively connected to drive gear 144 such that when input gear 142 rotates in rotational direction 149*a*, drive shaft 134 rotates in operative rotational direction 139 and when input gear 142 rotates in rotational direction 149*b*, drive shaft 134 is decoupled and does not rotate with input gear 142. In this manner, drive shaft 134 and toner agitators 136 do not rotate while sensor 300 performs a reading of encoded member 150. As a result, torque on drive shaft 134 and toner agitators 136 from toner stored in reservoir 104 does not affect the movement of encoded member 150 thereby permitting better control of encoded member 150 while sensor 300 performs a reading of encoded member 150 and improving the accuracy of the reading performed by sensor 300. Further, in some embodiments, toner agitators 136 may include flexible wipers that could displace or become damaged upon rotating counter to operative rotational direction 139. Decoupling drive shaft 134 from input gear 142 when input gear 142 rotates in rotational direction 149*b* prevents this from occurring.

Figure 9:
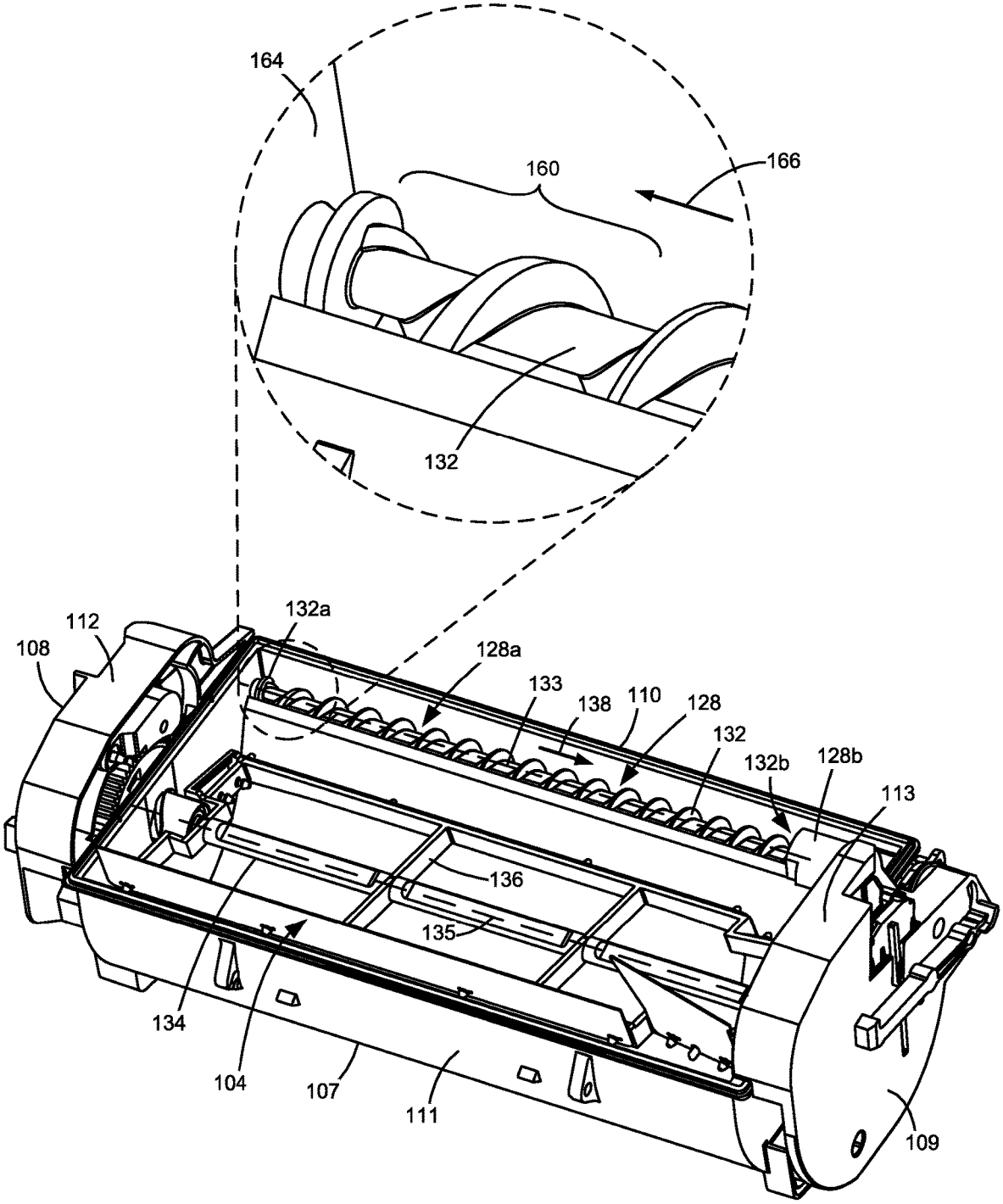
FIG. 9 is a perspective view of the toner cartridge shown in FIGS. 2-6 with a top portion of the toner cartridge omitted to show an auger of the toner cartridge according to one example embodiment.
Figure 10:
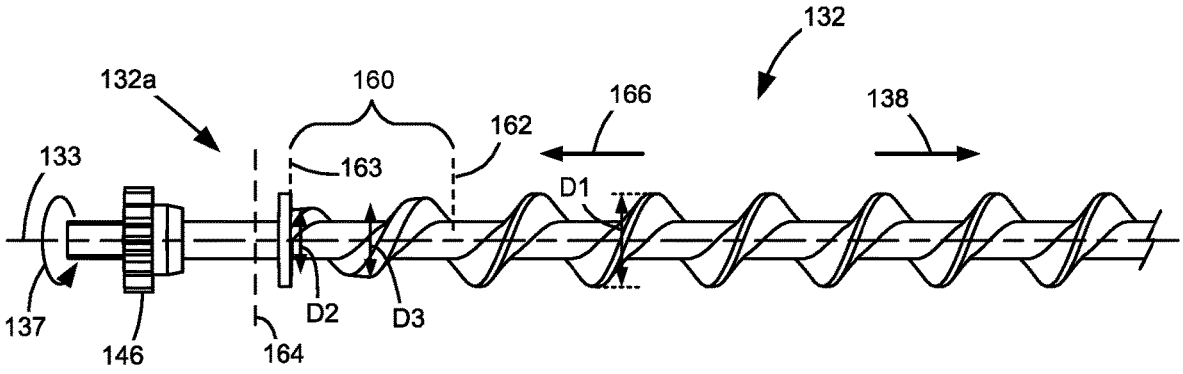
FIG. 10 is an elevation view of the auger shown in FIG. 9.

With reference to FIGS. 9 and 10, a segment 160 of auger 132 at first end 132*a* of auger 132 includes a reduced outer diameter (e.g., relative to the rest of auger 132) to mitigate the risk of a torque increase when input gear 142 rotates in rotational direction 149*b*, such as during a reading of encoded member 150, and auger 132 rotates counter to operative rotational direction 137. In the example embodiment illustrated, segment 160 of auger 132 having a reduced outer diameter includes the last one-and-a-half (1.5) turns of the pitch of auger 132 at first end 132*a* of auger 132. However, a greater or smaller segment of auger 132 may include a reduced outer diameter as desired. For example, in some embodiments, at least one full pitch of auger 132 has a reduced outer diameter. In the example embodiment illustrated, the portions of auger 132 outside of segment 160, e.g., the portion of auger 132 extending from an inner axial end 162 of segment 160 to second end 132*b* of auger 132, include a substantially constant outer diameter that is greater than the reduced outer diameter of segment 160. In the embodiment illustrated, the outer diameter of auger 132 gradually tapers from an outer diameter D1 at inner axial end 162 of segment 160 to an outer diameter D2 at an end 163 of the flight of auger 132, where D2 is less than D1. For illustrative purposes, FIG. 10 also shows an outer diameter D3 at a point intermediate inner axial end 162 of segment 160 and end 163 of the flight of auger 132, where D3 is less than D1 and greater than D2.

The reduced outer diameter of segment 160 of auger 132 helps reduce the efficiency of auger 132 at end 132*a* when input gear 142 rotates in rotational direction 149*b* and auger 132 rotates counter to operative rotational direction 137. The reduced efficiency of auger 132 at end 132*a* when rotating counter to operative rotational direction 137 helps prevent auger 132 from packing toner against an inner surface 164 of side wall 114, which is positioned transverse to rotational axis 133 of auger 132 (e.g., orthogonal to rotational axis 133 of auger 132), due to auger 132 feeding toner in a direction 166 opposite toner feed direction 138 when auger 132 rotates counter to operative rotational direction 137. Inner surface 164 of side wall 114 is illustrated schematically in FIG. 10. Toner packing against inner surface 164 of side wall 114 may tend to increase the torque on auger 132 and the rest of drive train 140, including input gear 142 and encoded member 150, when input gear 142 rotates in rotational direction 149*b*. Reducing the occurrence of toner packing against inner surface 164 of side wall 114 and the resulting increased torque on auger 132 helps reduce torque effects on the movement of encoded member 150 thereby permitting better control of encoded member 150 while sensor 300 performs a reading of encoded member 150 and improving the accuracy of the reading performed by sensor 300. Further, it has been found that the reduced efficiency of auger 132 at end 132*a* does not significantly impede the ability of auger 132 to move toner in toner feed direction 138 to deliver toner to outlet port 118 during a toner feed operation when input gear 142 rotates in rotational direction 149*a* and auger 132 rotates in operative rotational direction 137.

While the example embodiment illustrated includes an auger 132 having a reduced outer diameter at one end 132*a* of auger 132 to reduce the efficiency of the auger 132 at that end in order to mitigate torque effects during a reading of an encoded member 150 when the auger 132 is rotated counter to its operative rotational direction 137, it will be appreciated that other embodiments may include an auger having a reduced outer diameter at one or both ends of the auger to reduce the efficiency of the auger at the end(s) in order to accommodate bi-directional rotation of the auger for other purposes. Further, while the example embodiment illustrated includes an auger 132 of a toner cartridge 100 having a reduced outer diameter at one end 132*a* of auger 132, it will be appreciated that an auger having a reduced outer diameter at one or both ends of the auger may be positioned in a toner reservoir of any desired toner container including, for example, a developer unit, an imaging unit, a waste toner container, etc.

While the example embodiment shown in FIG. 2 includes a pair of replaceable units in the form of toner cartridge 100 and imaging unit 200, it will be appreciated that the replaceable unit(s) of image forming device 22 may employ any suitable configuration as desired. For example, in one embodiment, the main toner supply for image forming device 22, developer unit 202 and cleaner unit 204 are housed in one replaceable unit. In another embodiment, the main toner supply for image forming device 22 and developer unit 202 are provided in a first replaceable unit (with the developer roll or magnetic roll of developer unit 202 forming the outlet of the first replaceable unit) and cleaner unit 204 is provided in a second replaceable unit. Further, while the example image forming device 22 discussed above includes one toner cartridge 100 and corresponding imaging unit 200, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow or magenta) and each imaging unit corresponding with one of the toner cartridges to permit color printing.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner container for use in an electrophotographic image forming device, comprising:

a housing having a reservoir for holding toner; and an auger in the reservoir having a screw flight, the auger has a first end and a second end, the auger is rotatable about a rotational axis in an operative rotational direction for moving toner within the reservoir and in a direction counter to the operative rotational direction, the screw flight of the auger is configured to move toner away from the first end of the auger and toward the second end of the auger when the auger rotates in the operative rotational direction, a first end of the screw flight that is proximate to the first end of the auger is positioned adjacent to an interior wall of the housing that is transverse to the rotational axis of the auger, a segment of the screw flight at the first end of the screw flight has an outer diameter that is reduced in comparison with an outer diameter of the screw flight outside the segment of the screw flight to reduce an efficiency of the auger at the first end of the screw flight for reducing toner packing against the interior wall of the housing when the auger rotates in the direction counter to the operative rotational direction.

2. The toner container of claim 1, wherein the segment of the screw flight at the first end of the screw flight includes at least one full pitch of the screw flight of the auger having an outer diameter that is reduced in comparison with the outer diameter of the screw flight outside the segment of the screw flight.

3. The toner container of claim 1, wherein the screw flight outside the segment of the screw flight has a constant outer diameter that is greater than the outer diameter of the segment of the screw flight at the first end of the screw flight.

4. The toner container of claim 1, wherein the outer diameter of the segment of the screw flight at the first end of the screw flight tapers from a first outer diameter D1 at an inner axial end of the segment of the screw flight to a second outer diameter D2 at the first end of the screw flight, wherein the second outer diameter D2 is less than the first outer diameter D1, wherein the inner axial end of the segment of the screw flight is positioned at an opposite end of the segment of the screw flight from the first end of the screw flight.

5. The toner container of claim 1, further comprising an outlet port on the housing in fluid communication with the reservoir for exiting toner from the toner container, wherein the auger is positioned to move toner to the outlet port when the auger rotates in the operative rotational direction for exiting toner from the toner container.

6. The toner container of claim 1, further comprising:

an input gear positioned on the housing for mating with a corresponding output gear in the image forming device when the toner container is installed in the image forming device; and an encoded member encoded with identifying information of the toner container and operatively connected to the input gear such that rotation of the input gear in a first rotational direction causes movement of the encoded member for communicating the identifying information of the toner container to a sensor of the image forming device when the toner container is installed in the image forming device, wherein the auger is operatively connected to the input gear such that rotation of the input gear in a second rotational direction opposite the first rotational direction causes the auger to rotate in the operative rotational direction and rotation of the input gear in the first rotational direction causes the auger to rotate in the direction counter to the operative rotational direction.

7. A toner container for use in an electrophotographic image forming device, comprising:

a housing having a reservoir for holding toner;

an outlet port on the housing in fluid communication with the reservoir for exiting toner from the toner container;

an input gear positioned on the housing for mating with a corresponding output gear in the image forming device when the toner container is installed in the image forming device;

an encoded member encoded with identifying information of the toner container and operatively connected to the input gear such that rotation of the input gear in a first rotational direction causes movement of the encoded member for communicating the identifying information of the toner container to a sensor of the image forming device when the toner container is installed in the image forming device; and an auger rotatably positioned in the reservoir and having a screw flight, the auger has a first end and a second end, the auger is operatively connected to the input gear such that rotation of the input gear in a second rotational direction opposite the first rotational direction causes the auger to rotate in an operative rotational direction and rotation of the input gear in the first rotational direction causes the auger to rotate counter to the operative rotational direction, the screw flight of the auger is configured to move toner away from the first end of the auger and toward the second end of the auger to the outlet port when the auger rotates in the operative rotational direction for exiting toner from the toner container, an end segment of the screw flight at a first end of the screw flight that is proximate to the first end of the auger has an outer diameter that is less than an outer diameter of the screw flight outside the end segment of the screw flight.

8. The toner container of claim 7, wherein the end segment of the screw flight includes at least one full pitch of the screw flight of the auger having an outer diameter that is less than the outer diameter of the screw flight outside the end segment of the screw flight.

9. The toner container of claim 7, wherein the screw flight outside the end segment of the screw flight has a constant outer diameter that is greater than the outer diameter of the end segment of the screw flight.

10. The toner container of claim 7, wherein the outer diameter of the end segment of the screw flight tapers from a first outer diameter D1 at an inner axial end of the end segment of the screw flight to a second outer diameter D2 at the first end of the screw flight, wherein the second outer diameter D2 is less than the first outer diameter D1, wherein the inner axial end of the end segment of the screw flight is positioned at an opposite end of the end segment of the screw flight from the first end of the screw flight.

* * * * *